United States Patent [19]

Tremmel

[11] 4,179,343

[45] Dec. 18, 1979

[54] ELECTROPLATING BATH AND PROCESS FOR PRODUCING BRIGHT, HIGH-LEVELING NICKEL IRON ELECTRODEPOSITS

[75] Inventor: Robert A. Tremmel, Woodhaven, Mich.

[73] Assignee: Oxy Metal Industries Corporation, Warren, Mich.

[21] Appl. No.: 11,270

[22] Filed: Feb. 12, 1979

[51] Int. Cl.[2] ..... C25D 3/56

[52] U.S. Cl. ..... 204/43 T

[58] Field of Search ..... 204/43 T, 123

[56] References Cited

U.S. PATENT DOCUMENTS

| | | | |
|---|---|---|---|
| 2,647,866 | 8/1953 | Brown | 204/49 |
| 3,023,151 | 2/1962 | Strauss et al. | 204/49 |
| 3,354,059 | 11/1967 | Koretzky | 204/12 |
| 3,795,591 | 3/1974 | Clauss et al. | 204/43 T |
| 3,806,429 | 4/1974 | Clauss et al. | 204/41 |
| 3,812,566 | 5/1974 | Clauss | 204/43 T X |
| 3,878,067 | 4/1975 | Tremmel | 204/43 T |
| 3,974,044 | 8/1976 | Tremmel | 204/43 T |
| 3,994,694 | 11/1976 | Clauss et al. | 428/613 |
| 4,002,543 | 1/1977 | Clauss et al. | 204/41 |
| 4,089,754 | 5/1978 | Tremmel et al. | 204/43 T |

FOREIGN PATENT DOCUMENTS

| | | | |
|---|---|---|---|
| 206265 | 12/1968 | U.S.S.R. | 204/43 T |

*Primary Examiner*—G. L. Kaplan

*Attorney, Agent, or Firm*—Richard P. Mueller

[57] ABSTRACT

An aqueous bath and process for the electrodeposition of bright, high-leveling nickel-iron alloy deposits on a conductive substrate comprising controlled effective amounts of nickel ions, iron ions, a bath soluble tartrate complexing agent, a reducing mono or disaccharide, ascorbic and/or isoascorbic acid, a buffering agent, a mixture of primary and secondary nickel brightening agents and hydrogen ions to provide a pH of about 2.6 to about 4.5.

14 Claims, No Drawings

ELECTROPLATING BATH AND PROCESS FOR PRODUCING BRIGHT, HIGH-LEVELING NICKEL IRON ELECTRODEPOSITS

BACKGROUND OF THE INVENTION

A variety of aqueous electroplating bath compositions and processes for electrodepositing a nickel-iron alloy on electrically conductive substrates are known in the art and are in widespread commercial use. Nickel-iron electrodeposits because of their excellent corrosion resistance are particularly useful for providing decorative finishes on corrosion susceptible substrates over which a subsequent electrodeposition of chromium is applied. In order to achieve satisfactory nickel-iron deposits for decorative purposes it is extremely important that such electrodeposits are characterized by their high-leveling properties, brightness and good ductility and that uniformity in these beneficial characteristics are achieved over the entire electrodeposit.

Typical of nickel-iron electroplating bath compositions and processes are those described in prior U.S. Pat. Nos. 3,354,059; 3,795,591; 3,806,429; 3,812,566; 3,878,067; 3,974,044; 3,994,694; 4,002,543; and 4,089,754. The majority of the aforementioned U.S. patents are directed to nickel-iron electroplating compositions and processes for electrodepositing decorative nickel-iron deposits on conductive substrates and incorporate various additive agents and combination of additives for increasing the leveling of the deposit and to increase brightness. While certain of the nickel-iron plating bath compositions have provided for satisfactory electrodeposits for use in decorative applications, there has been a continuing need for improved bath compositions which provide for still further improvements in the leveling characteristics and brightness of the deposit formed. The use of selected primary and secondary brighteners and combination of brighteners of the types heretofore known in such electroplating baths have enhanced the brightness of the deposit obtained but their effectiveness tends to peak out before an electrodeposit of super brightness and leveling can be obtained.

The choice of complexing agents used to stabilize the iron has also been recognized as an important factor on the brightness and leveling of the electrodeposits obtained. For example, a citrate complexing agent not only complexes the iron ions present but also the nickel ions in the bath. Because of the presence of the nickel citrate complex, the resultant brightness and leveling of the electrodeposits is at best average. The use of gluconates as a complexing agent provides the advantage that it does not complex nickel and therefore somewhat better leveling is obtained. However, the iron gluconate complex possesses characteristics which somewhat restrict the leveling of the electrodeposit obtained.

Attempts to increase the operating pH of the bath has resulted in some improvement in the leveling and brightness of the electrodeposit obtained. However, at such higher pH levels, an increase in the ferric ion concentration occurs rendering the operating bath very sensitive to high iron concentrations and to the organic addition agents present detracting from efficient use and simple control of the operating bath.

The use of reducing saccharides in combination with selected complexing agents such as those disclosed in U.S. Pat. No. 3,974,044 has been found to result in good leveling and brightness of the nickel-iron alloy deposit with low sensitivity to high iron concentrations and the presence of organic additives, such as secondary brightener additives. The use of tartrates instead of the complexing agents disclosed in U.S. Pat. No. 3,974,044, results in significantly improved leveling and brightness of the nickel-iron alloy deposit but there is a marked increase in the sensitivity of the bath to iron and organic additives. A further problem is evidenced by an apparent interference of such compositions with the buffering additives employed causing the pH of the bath to rise very rapidly during use requiring constant pH adjustment and the associated expense and difficulty of such control to maintain the bath within satisfactory operating parameters.

The present invention provides for a further improvement in nickel-iron electroplating bath compositions and processes by overcoming many of the problems and disadvantages associated with prior art compositions and techniques while at the same time attaining nickel-iron electrodeposits which are characterized by their extremely high-leveling and brightness characteristics. The bath composition and process of the present invention is further characterized by its ability to achieve extraordinary brightness and leveling over a broad pH range even when depositing nickel-iron alloys containing 35% iron and higher while simultaneously providing a bath of reduced sensitivity to iron concentration and to the presence of high concentrations of secondary organic addition agents.

SUMMARY OF THE INVENTION

The benefits and advantages of the present invention are based on the discovery of an nickel-iron electroplating bath containing controlled effective amounts of a combination of specific constituents which provide for a synergistic effect on the extraordinary brightness and leveling obtained on the nickel-iron deposit while at the same time providing a relatively stable operating bath which is tolerant of relatively high iron contents and organic addition agents and which is simple to control and of versatile use. The electroplating bath composition of the present invention contains as its essential constituents, an effective amount of nickel and iron ions sufficient to produce a nickel-iron alloy deposit of the desired composition. In addition, the bath contains a tartrate complexing agent; a reducing saccharide; about 0.5 to about 3 grams/liter (g/l) of ascorbic acid, isoascorbic acid, the bath soluble salts thereof, and mixtures thereof; a controlled amount of a buffering agent such as boric acid and/or sodium acetate; and a primary or carrier brightener comprising sulfo-oxygen and/or sulfur bearing compounds, in further combination with a secondary brightener agent. The bath further contains a hydrogen ion concentration to provide an operating pH of from about 2.6 to about 4.5.

In accordance with the process aspects of the present invention, a nickel-iron alloy electrodeposit is produced on electrically conductive substrates employing an electroplating bath of the aforementioned type in which the bath is maintained at an operating temperature of from about 105° F. up to about 180° F. The substrate usually is immersed in the bath for a period of about 5 up to about 30 minutes or such other time to achieve the desired thickness of the electrodeposit while the substrate is cathodically charged and at an average bath current density ranging from about 5 up to about 100 amperes per square foot (ASF).

Additional benefits and advantages of the present invention will become apparent upon a reading of the description of the preferred embodiments taken in conjunction with the specific examples provided.

DESCRIPTION OF THE PREFERRED EMBODIMENTS

The present invention is directed to an improved electroplating bath composition and process for producing exceptionally bright and level nickel-iron alloy deposits on electrically conductive substrates which can be utilized as a base for subsequent electrodeposition of chromium in order to impart desirable decorative and/or corrosion resistant properties to the substrate. While the composition and process is primarily applicable for applying plating deposits on metallic substrates, it is also contemplated that the invention can be applied to plastic substrates which have been subjected to a suitable pretreatment in accordance with well known techniques to provide an electrically conductive coating thereover such as nickel or copper rendering the plastic substrate receptive to the nickel-iron alloy electroplating operation. A variety of plastic materials can thus be electroplated of which ABS, polyolefin, polyvinyl chloride, and phenol-formaldehyde polymers are typical.

The extraordinary and unexpected brightness and leveling of the nickel-iron alloy deposit of the present invention is achieved by employing an electroplating bath containing as its essential constituents, nickel and iron ions, a specific complexing agent, a reducing saccharide, ascorbic and/or isoascorbic acid and/or selected salts thereof, a buffering agent, and a combination of primary and secondary brighteners. The bath further contains a controlled hydrogen ion concentration to provide a bath operating pH ranging from about 2.6 to about 4.5, and preferably from about 3.0 to about 3.6.

In accordance with the process aspects of the present invention, substrates to be electroplated are immersed in the electroplating bath while cathodically charged and are electroplated at average current densities of about 5 up to about 100 ASF, preferably 30 to about 60 ASF, for periods of time to provide the desired plating thickness. Usually plating thicknesses for decorative purposes range from about 0.1 mols to about 2 mils with thicknesses of about 0.2 to about 0.5 mils being typical. The operating bath is usually maintained at a temperature ranging from 105° F. up to about 180° F. with temperatures of about 130° F. to about 140° F. being preferred. Plating durations of from about 5 minutes to about 30 minutes are usually satisfactory in consideration of the specific current density employed and the thickness of the plating deposits desired. Agitation of the bath during electroplating is not necessary but is preferred employing conventional agitation means such as mechanical agitation, air agitation, and the like.

In accordance with the composition aspects of the present invention, the nickel and iron ions are introduced into the bath employing bath soluble and compatible nickel and iron compounds. Preferably, inorganic nickel salts are employed such as nickel sulfate, nickel chloride, and the like as well as other nickel materials such as nickel sulfamate and the like. When nickel sulfate or sulfamate salts are used they are conventionally employed in amounts ranging from 40 up to about 300 g/l (calculated as nickel sulfate hexahydrate). Nickel chloride can also be used and is normally employed in an amount ranging from about 40 to about 250 g/l. The chloride or halide ions introduced provide for satisfactory conductivity of the bath and also provide satisfactory corrosion properties of the soluble anodes.

The iron compounds preferably comprise inorganic ferrous salts such as ferrous sulfate, ferrous chloride, and the like. Such ferrous salts are usually employed in amounts ranging from about 2 up to about 60 g/l. Additionally, other bath soluble compatible iron salts can be employed such as soluble ferrous fluoborate, sulfamate, and the like.

The concentration of nickel and iron ions in the bath is usually controlled to provide a weight ratio of nickel to iron ranging from about 5:1 up to about 50:1.

The aqueous bath further contains a complexing agent for the iron constituent comprising a compound selected from the group consisting of tartaric acid, bath soluble salts thereof, such as nickel, iron, mono and/or di-alkali metal salts, and mixtures thereof. The term "alkali metal salts" as herein employed and as set forth in the subjoined claims is used in its broad sense to include the alkali metals, sodium, potassium and lithium as well as ammonium ($NH_4$). The complexing agent can be conveniently introduced in the form of Rochelle salts comprising potassium-sodium tartrate of $L^+$ tartaric acid. The complexing agent can be employed in amounts of about 5 up to about 100 g/l with amounts of about 15 to about 30 g/l being preferred. Generally, concentrations of the complexing agent above about 50 g/l are unnecessary and in some instances may be undesirable due to the formation of insoluble degradation products over prolonged operating periods of the plating bath. The use of such higher concentrations may also be undesirable from an economic standpoint.

The ratio of the complexing agent relative to the iron ion concentration present is preferably within the range of from about 1:1 up to about 20:1. At ratios below 1:1, the iron constituent may precipitate out while at ratios above about 20:1 excessive concentrations of complexing agent may be present, providing the disadvantages and potential problems as hereinabove set forth.

In addition to the nickel and iron ions and complexing agent, the bath further contains as an essential constituent, a controlled amount of a reducing saccharide. The reducing saccharide or mixture of saccharides which can satisfactorily be employed in accordance with the present invention can be either a monosaccharide or a disaccharide. The monosaccharides can be defined as polyhydroxyaldehydes or polyhydroxyketones with at least three aliphatically bound carbon atoms. The simplest monosaccharides are glyceraldehyde (generally termed aldose) and dihydroxyacetone (generally termed ketose). Other suitable monosaccharides useful in the practice of the present invention include dextrose, sorbose, fructose, xylose, erythrose and arabinose. Disaccharides are glucoside-type derivatives of monosaccharides, in which one sugar forms a glucoside with an —OH group of some other sugar. Disaccharides suitable for use in the practice of the present invention include lactose, maltose and turanose. Other disaccharides in which the second monosaccharide may, at least momentarily, possess a free carbonyl group may also be utilized.

The reducing saccharide can be employed in amounts ranging from about 1 to about 50 g/l with amounts of about 2 to about 5 g/l being preferred. The reducing saccharide functions as a mild reducing agent for ferric ions present but additionally provides for exceptional brightness and leveling of the nickel-iron electrodeposit in combination with the tartrate-type complexing agents and primary and secondary brighteners providing a synergistic effect which is not completely understood at the present time.

A further essential constituent of the bath comprises ascorbic acid and/or isoascorbic acid, the bath soluble salts, such as the alkali metal salts, thereof, as well as mixtures thereof. This constitutent can be employed in amounts ranging from about 0.5 up to about 3 g/l with amounts of about 1 to about 2 g/l being preferred. Amounts of this constituent above about 3 g/l are undesirable because of a reduction in the brightness and leveling obtained in comparison to that achieved when amounts less than 3 g/l are used. Additionally, amounts of this constituent in excess of about 3 g/l also results in the formation of bath insoluble degradation products over prolonged periods of use of the bath causing excessive sludging of the bath and associated equipment. The use of the ascorbic and/or isoascorbic constituent in combination with the remaining bath constituents prevents a rapid pH rise of the bath during use and further reduces the sensitivity of the bath to high iron concentrations and sensitivity of high organic concentrations such as secondary brighteners which heretofore has resulted in the formation of dark recesses on substrates being plated, poor adhesion of the electrodeposit as well as high stress in the plating.

The electroplating bath further contains as an essential constituent, a buffering agent such as boric acid and/or sodium acetate and the like which may be present in an amount of about 30 up to about 60 g/l with amounts of about 40 to about 50 g/l being preferred. Of the various buffering agents that can be satisfactorily employed, boric acid comprises the preferred material.

The bath further contains as essential constituents, controlled amounts of primary or so-called carrier brighteners in combination with secondary brighteners to attain the exceptional brightness and high-leveling of the nickel-iron deposit. The primary brighteners are usually employed in amounts ranging from about 0.5 to about 20 g/l with amounts of about 2 to about 8 g/l being preferred. The secondary brighteners are usually employed in amounts of about 0.25 mg/l up to about 1 g/l. The primary and secondary brighteners, when an acid is involved, can be introduced into the bath in the form of the acid itself or as a salt having bath soluble cations such as the alkali metal ions including ammonium.

The primary brighteners suitable for use include those as described in U.S. Pat. No. 3,974,044, the substance of which is incorporated herein by reference. Such primary brighteners as described in the aforementioned patent comprise sulfo-oxygen compounds of sulfur-bearing compounds as further described in "Modern Electroplating" published by John Wiley and Sons, second edition, page 272. Included among such primary brighteners are saccharin, naphthalenetrisulfonic, sulfobenzaldehyde, dibenzenesulfonamide, sodium allyl sulfonate, benzene sulfinates, vinyl sulfonate, beta-styrene sulfonate, cyano alkane sulfonates (having from 1 to 5 carbon atoms), and the like. Other bath soluble sulfo-oxygen compounds are those such as the unsaturated aliphatic sulfonic acids, mononuclear and binuclear aromatic sulfonic acids, mononuclear aromatic sulfinic acids, mononuclear aromatic sulfonamides and sulfonimides, and the like. Of the foregoing, saccharin itself or saccharin in combination with allyl sulfonate and/or vinyl sulfonate comprise a preferred primary brightener.

Suitable secondary brighteners include acetylenic nickel brighteners such as the acetylenic sulfo-oxygen compounds described in U.S. Pat. No. 2,800,440. These nickel brighteners are the oxygen containing acetylenic sulfo-oxygen compounds. Other acetylenic nickel brighteners are those described in U.S. Pat. No. 3,366,667 such as the polyethers resulting from the condensation reaction of acetylenic alcohols and diols such as, propargyl alcohol, butyndiol, and the like and lower alkylene oxides such as, epichlorohydrin, ethylene oxide, propylene oxide and the like.

Additional secondary brighteners that are suitable include nitrogen heterocyclic quaternary or betaine nickel brighteners which are usually employed in amounts of about 1 to about 150 mg/l. Compounds of this type suitable are those described in U.S. Pat. No. 2,647,866 and the nitrogen heterocyclic sulfonates described in U.S. Pat. No. 3,023,151. Preferred compounds described therein are the pyridine quaternaries or betaines or the pyridine sulfobetaines. Suitable quaternaries that may be employed are quinaldine propane sultone, quinaldine dimethyl sulfate, quinaldine allyl bromide, pyridine allyl bromide, isoquinaldine propane sultone, isoquinaldine dimethyl sulfate, isoquinaldine allyl bromide, and the like.

In addition, secondary brighteners further include the reaction product of a polyamine-type brightener which has a molecular weight ranging from 300 to about 24,000, and an alkylating agent of the type described in U.S. Pat. No. 4,002,543 the substance of which is incorporated herein by reference. Exemplary alkalating agents are dimethyl sulfate, chloroacetic acid, allyl bromide, propane sultone, benzyl chloride or propargyl bromide. The polyamine brightener may be sulfonated utilizing as exemplary compounds sulfamic acid, chloro sulfonic acid and the like. The ratio of polyamine to alkylating agent or to the sulfonating agent can be varied so that every amino group need not be alkylated or sulfonated as the case may be.

In addition to the essential primary and secondary brighteners and other bath constituents, an optional addition agent comprises special carrier agents of the type described in U.S. Pat. No. 3,806,429, the substance of which is incorporated herein by reference. Such optional special additives are not required in achieving the exceptional brightness and high leveling in accordance with the present invention but their inclusion in the bath is usually preferred to assure bright nickel-iron deposits over the entire surface of the substrate, even those exposed to very low current densities. Such specialty additives comprise organic sulfide compounds which are normally employed in amounts ranging from about 0.5 to about 40 mg/l and are of the formula:

$$R_1N{=}\overset{\overset{\displaystyle R_2}{|}}{C}{-}S{-}R_3$$

where $R_1$ is hydrogen or a carbon atom or an organic radical, $R_2$ is nitrogen or a carbon atom of an organic radical and $R_3$ is a carbon atom of an organic radical. $R_1$ and $R_2$ or $R_3$ may be linked together through a single organic radical Typically, the bath soluble organic sulfide compounds can be 2-amino thiazoles and isothioureas. 2-aminothiazole and 2-aminobenzothiazole can be reacted with bromethane sulfonate, propane sultone, benzyl chloride, dimethylsulfate, diethyl sulfate, methyl bromide, propargyl bromide, ethylene dibromide, allyl bromide, methyl chloro acetate, sulfophenoxyethylene bromide, to form compounds suitable for use. Substituted 2-aminothiazoles and 2-aminobenzothiazoles, such as 2-amino-5-chlorothiazole, 2-amino-4-methylthiazole, etc. can also be employed. Thiourea can be reacted with propiolactone, butyrolactone, chloroacetic acid, chloropropionic acid, propane sultone, dimethyl sulfate, etc. Also, phenyl thiourea, methyl thiourea, allyl thiourea and other similar substituted thioureas can be used to form suitable reacted compounds.

The maintenance of an appropriate operating pH of the bath can be achieved employing conventional acids used in nickel-iron plating baths of which sulfuric acid and hydrochloric acid are preferred.

In order to further illustrate the electroplating bath composition and process of the present invention, the following specific examples are provided. It will be understood that the examples are provided for illustrative purposes and are not intended to be limiting of the scope of the present invention as set forth in the subjoined claims.

EXAMPLE 1

An aqueous nickel-iron plating bath was prepared having the following composition:

| | |
|---|---|
| $NiSO_4$ $6H_2O$ | 150 g/l |
| $NiCl_2$ $6H_2O$ | 75 g/l |
| $FeSO_4$ $7H_2O$ | 15 g/l |
| $H_3BO_3$ | 45 g/l |
| Sodium Gluconate | 20 g/l |
| Saccharin | 2½ g/l |
| Sodium Allyl Sulfonate | 3 g/l |
| Propargyl Alcohol Ethylene Oxide | 23 mg/l |
| pH | 3.3 |
| Temperature | 135° F. |
| Agitation | Air |

A polished steel panel having 180 grit polishing lines was plated at 30 ASF for 15 minutes. The resulting deposit was overall bright and its leveling when rated on a scale of 1–10 was 5 on the front side and 4 on the back.

EXAMPLE 2

A bath with the identical composition of Example 1 was prepared except that the sodium gluconate was replaced with 15 g/l of sodium tartrate. A 180 polished steel panel was again plated for 15 minutes at 30 ASF. The pH was carefully monitored during electrolysis and maintained at 3.2. The resulting deposit was overall bright and the leveling rated on a scale of 1–10, was 5.5 on the front side and 4.0 on the back.

EXAMPLE 3

5 g/l of dextrose was added to the bath described in Example 2. All other bath components, as well as pH and temperature, were maintained at exactly the same levels. A 180 polished steel panel was again plated at 30 ASF for 15 minutes. The pH was again carefully monitored during electrolysis and maintained at 3.2. The resulting deposit was overall bright and the leveling on a scale of 1–10 was 7.0 on the front and 6 on the back.

EXAMPLE 4

An aqueous nickel-iron plating bath was prepared having the following composition:

| | |
|---|---|
| $NiSO_4$ $6H_2O$ | 150 g/l |
| $NiCl_2$ $6H_2O$ | 75 g/l |
| $FeSO_4$ $7H_2O$ | 15 g/l |
| Rochelle Salts | 18 g/l |
| Lactose | 5 g/l |
| $H_3BO_3$ | 45 g/l |
| Saccharin | 2½ g/l |
| Sodium Allyl Sulfonate | 3 g/l |
| Propargyl Alcohol Ethylene Oxide | 25 mg/l |
| pH | 3.2 |
| Temperature | 140° F. |
| Agitation | Air |

A polished steel panel, which was rolled up at the end and having a 180 grit finish, was plated for 15 minutes at 30 ASF. The resulting deposit was very bright with exceptional leveling (7.0 avg.) but the pH of the bath had risen from 3.2 to 3.8. As a result, the deposit had dark recess areas, with some gray-white blotchiness, and exfoliated upon bending.

EXAMPLE 5

0.75 g/l of isoascorbic (erythorbic) acid was added to the plating solution of Example 4. A 180 polished steel panel was plated using the identical conditions described in Example 4. The resulting deposit was overall bright, ductile with excellent recess areas and good adhesion. The leveling was comparable and the pH had risen to only 3.25.

EXAMPLE 6

The process described in Example 5 was repeated, but this time 1.5 g/l of ascorbic acid was used in place of the isoascorbic (erythorbic) acid. The results were identical.

EXAMPLE 7

An aqueous nickel-iron plating bath was prepared having the identical composition as described in Example 5, except that 2 g/l of sodium citrate was added to the bath in place of isoascorbic acid. A 180 polished steel panel was plated, again using the same conditions described in Example 5. The resulting deposit was overall bright, with some darkness in the recess, and had some exfoliation upon bending. The leveling was slightly poorer (6.5 avg.) and the pH rose from 3.2 to 3.5.

The sodium citrate was increased to 5 g/l and the experiment repeated. Now the deposit was overall bright with a good recess and excellent adhesion. The pH only rose to 3.25, but the leveling was dramatically reduced (4.5 avg.).

EXAMPLE 8

Example 7 was repeated using sodium gluconate in place of sodium citrate. Panels were plated at 2 and at 5 g/l concentrations of sodium gluconate. Results were similar to those obtained with citrate in that the gluconate improved the physical properties and maintained relatively consistent pH, (3.2–3.35). However, the loss of leveling, while not as dramatic as with the citrate, was still substantial (5.0 avg.).

The results obtained in accordance with Examples 1 through 8 as hereinbefore described clearly substantiates the benefits attainable in accordance with the practice of the present invention. In accordance with Example 1, only average brightness and leveling is attained employing sodium gluconate as the complexing agent. In Example 2, in which sodium tartrate is substituted for the sodium gluconate constituent, substantially similar results are obtained as were obtained in Example 1. According to Example 3, the addition of a reducing saccharide to the bath of Example 2 provided outstanding leveling and brightness but required a constant monitoring of the pH of the bath by acid addition to maintain the bath at a proper pH level. Such constant monitoring is often commercially impractical.

According to Example 4, a bath similar to that of Example 3 but in which lactose was substituted for dextrose as the reducing saccharide, and without monitoring the pH, an inferior deposit was obtained accompanied by a relatively significant rise in pH during the course of the electroplating operation. By the controlled addition of a small but effective amount of isoascorbic acid (also called erythorbic acid), in Example 5, exceptionally bright and level deposits were attained over the entire surface area which were of good adhesion and mechanical properties. These excellent results were obtained with only a relatively insignificant increase in the pH of the bath. Similarly, in accordance with Example 6, ascorbic acid provides substantially identical excellent results to those obtained employing isoascorbic acid pursuant to Example 5.

Examples 7 and 8 are indicative of the significant reduction in brightness and leveling obtained in a bath of Example 4 by the addition of sodium citrate or sodium gluconate, respectively, in an effort to reduce the rapid rise in pH through a buffering action. While some reduction in pH increase was obtained, the reduction in leveling and brightness of the electrodeposit was significant.

These results clearly substantiate the criticality and synergistic effect of the plating bath composition of the present invention in achieving exceptional brightness and high-leveling of nickel-iron alloy electrodeposits as typified by the results obtained in Example 5 and Example 6, while at the same time providing a bath which is relatively stable and simple to control.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An aqueous bath suitable for the electrodeposition of bright, high-leveling nickel-iron electrodeposits comprising nickel ions and iron ions, from about 5 to about 100 g/l of a complexing agent selected from the group consisting of tartaric acid, bath soluble salts thereof and mixtures thereof, from about 1 to about 50 g/l of a reducing saccharide, from about 0.5 to about 3 g/l of a compound selected from the group consisting of ascorbic acid, isoascorbic acid, bath soluble salts thereof and mixtures thereof, from about 30 to about 60 g/l of a buffering agent selected from the group consisting of boric acid and sodium acetate, from about 0.5 to about 20 g/l of a bath soluble primary brightener selected from the group consisting of sulfo-oxygen, sulfur bearing compounds, from about 0.25 mg/l to about 1 g/l of a secondary brightener, and hydrogen ions to provide a pH ranging from about 2.6 to about 4.5.

2. The bath as defined in claim 1 in which the weight ratio of nickel ions to iron ions ranges from about 5:1 up to about 50:1.

3. The bath as defined in claim 1 in which said complexing agent is present in an amount of about 15 to about 30 g/l.

4. The bath as defined in claim 1 in which said complexing agent is present in an amount to provide a weight ratio of iron ions to complexing agent of about 1:1 to about 20:1.

5. The bath as defined in claim 1 in which said reducing saccharide is selected from the group consisting of monosaccharides, disaccharides and mixtures thereof.

6. The bath as defined in claim 1 in which said reducing saccharide is present in an amount of about 2 to about 5 g/l.

7. The bath as defined in claim 1 in which the ascorbic or isoascorbic acid compound is present in an amount of about 1 to about 2 g/l.

8. The bath as defined in claim 1 in which said buffering agent is present in an amount of about 40 to about 50 g/l.

9. The bath as defined in claim 1 in which said primary brightener is present in an amount of about 2 to about 8 g/l.

10. The bath as defined in claim 1 in which said primary brightener comprises saccharin.

11. The bath as defined in claim 1 in which said primary brightener comprises saccharin in conbination with a brightener selected from the group consisting of sodium allyl sulfonate, vinyl sulfonate and mixtures thereof.

12. The bath as defined in claim 1 in which said hydrogen ions are present to provide a pH of about 3.0 to about 3.6.

13. The bath as defined in claim 1 in which said buffering agent comprises boric acid, said primary brightener comprises a mixture of saccharin and an alkali metal allyl sulfonate, said secondary brightener comprises propargyl alcohol ethylene oxide and said hydrogen ions are present to provide a pH of about 3.0 to about 3.6.

14. A process for electrodeposition of a bright, high-leveling nickel-iron deposit on an electrically conductive substrate including the steps of immersing the substrate in any one of the aqueous baths as defined in claim 1, or 2, or 3, or 4, or 5, or 6, or 7, or 8, or 9, or 10, or 11, or 12, or 13; applying a cathodic charge to said substrate to effect a progressive deposition of a nickel-iron electrodeposit thereon, controlling the bath at a temperature of about 105° F. to about 180° F., and continuing the electrodeposition of said nickel-iron electrodeposit until a desired thickness is obtained.

* * * * *